United States Patent [19]

Osawa et al.

[11] Patent Number: 4,472,242

[45] Date of Patent: Sep. 18, 1984

[54] METHOD OF PIPE LINE WASHING

[75] Inventors: Akira Osawa; Jun Nakamura, both of Yokohama; Tadashi Izawa; Yoshiyuki Saito, both of Kitagami, all of Japan

[73] Assignees: Mitsubishi Jukogyo Kabushiki Kaisha; Mitsubishi Seishi Kabushiki Kaisha, both of Tokyo, Japan

[21] Appl. No.: 356,154

[22] Filed: Mar. 8, 1982

[30] Foreign Application Priority Data

Mar. 9, 1981 [JP] Japan ..... 56-33669

[51] Int. Cl.[3] ..... D21C 9/02

[52] U.S. Cl. ..... 162/60; 8/156; 68/181 R

[58] Field of Search ..... 162/60; 68/181 R, DIG. 1; 8/156

[56] References Cited

U.S. PATENT DOCUMENTS 4,259,150 3/1981 Prough ..... 162/60

FOREIGN PATENT DOCUMENTS 565962 7/1977 U.S.S.R. ..... 162/60

*Primary Examiner*—Peter Chin

*Attorney, Agent, or Firm*—Wenderoth, Lind & Ponack

[57] ABSTRACT

A method of pipe line washing is described, in which raw pulp liquid is washed by clean water or washing liquid having a lower concentration than liquid chemicals in the raw pulp liquid by making use of all or a part of a pipe line.

2 Claims, 4 Drawing Figures

METHOD OF PIPE LINE WASHING

The present invention relates to a method of pipe line washing, in which digested pulp is washed with clean water to recover chemicals contained in the digested pulp.

Although it has been known and practiced to recover chemicals contained in digested raw pulp liquid by washing the raw pulp liquid with clean water, the washing efficiency was not so high in the method of the prior art and hence a considerably large amount of clean water was necessitated for washing raw pulp liquid.

It is therefore one object of the present invention to provide a novel method of pipe line washing in which a high washing efficiency can be attained with a minimum amount of clean water.

According to one feature of the present invention, there is provided a method of pipe line washing in which raw pulp liquid consisting of a mixture of pulp and liquid chemicals, is washed with clean water or washing liquid having a lower concentration than the liquid chemicals in the raw pulp liquid by making use of all or a part of a pipe line, whereby clean pulp can be obtained.

Figure 1:
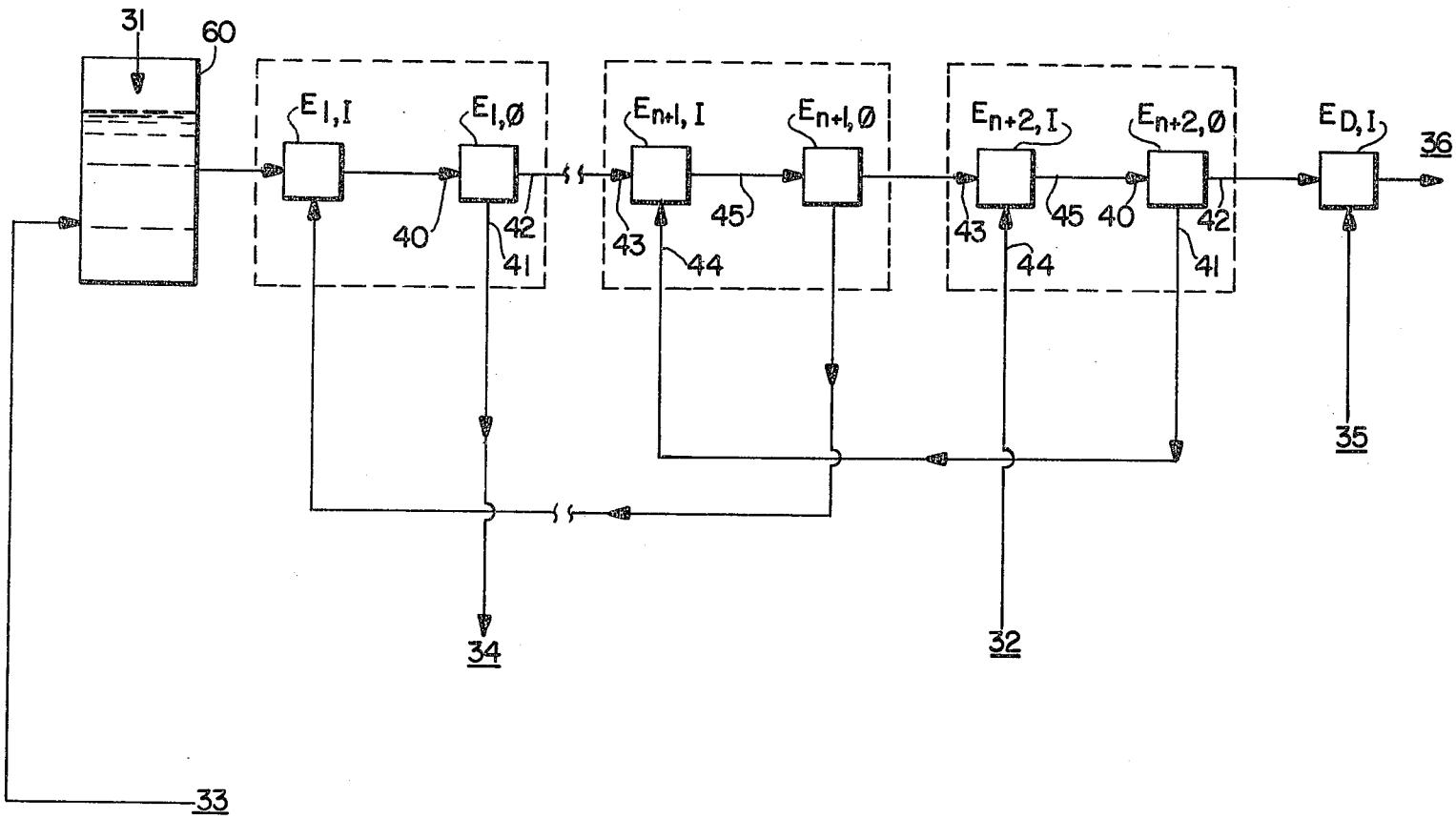
Figure 4:
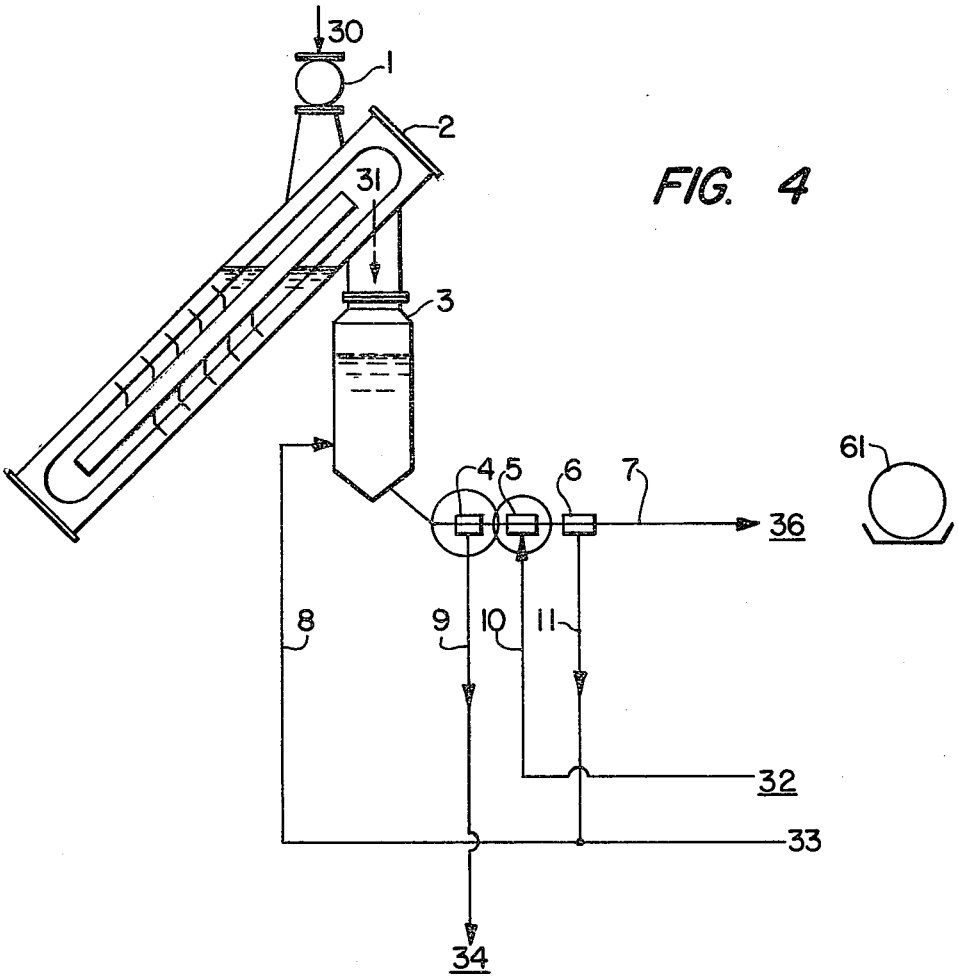
Figure 2:
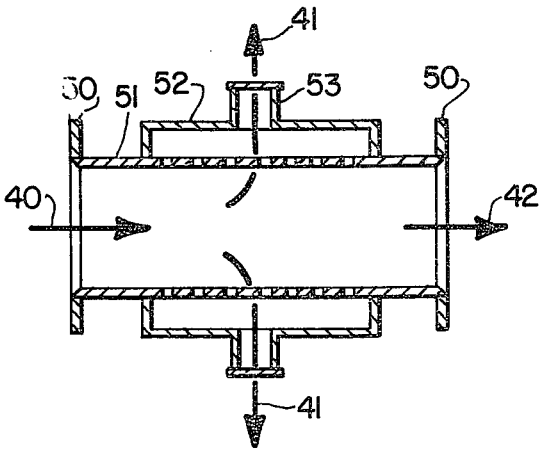
Figure 3:
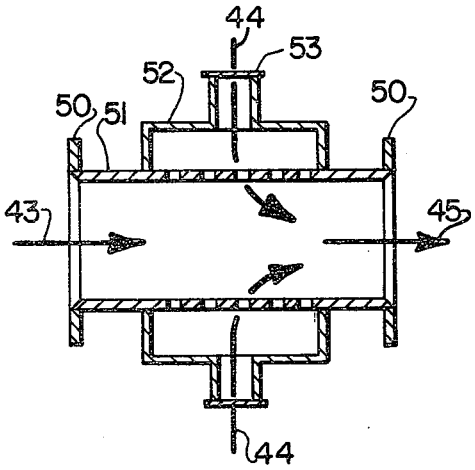

The above-mentioned and other features and objects of the present invention will become more apparent by reference to the following description of a preferred embodiment of the invention taken in conjunction with the accompanying drawings, wherein:

FIG. 1 is a flow sheet of a pipe line system in which the method according to the present invention is practiced, FIG. 2 is a longitudinal cross-section view showing one example of a concentrating pipe in the system shown in FIG. 1, FIG. 3 is a longitudinal cross-section view showing one example of a diluting pipe in the system shown in FIG. 1, and FIG. 4 is a system diagram of an installation in which the method according to the present invention is practiced.

Now the present invention will be described in greater detail in connection to one preferred embodiment thereof illustrated in the drawings. A general concept of the method according to the present invention is illustrated in FIG. 1, in which raw pulp liquid (31) consisting of a mixture of pulp and liquid chemicals introduced into a container (60) is made to sequentially flow through an alternate series of diluting pipes and concentrating pipes ($E_{1\cdot I}$, $E_{1\cdot\Phi}$, $E_{2\cdot I}$, $E_{2\cdot\Phi}$, —$E_{i\cdot I}$, $E_{i\cdot\Phi}$, —$E_{n+2\cdot I}$, $E_{n+2\cdot\Phi}$), where i represents successive numbers 1, 2, 3, —, a suffix I means a diluting pipe and a suffix Φ means a concentrating pipe.

Clean water or washing liquid (32) having a lower concentration than the raw pulp liquid is injected into the most downstream diluting pipe ($E_{2+n\cdot I}$) with respect to the flow of raw pulp liquid. In this diluting pipe ($E_{2+n\cdot I}$), the raw pulp liquid is diluted and in the concentrating pipe ($E_{2+n\cdot\Phi}$) located downstream thereof only the washing liquid is extracted. The washing liquid extracted from the concentrating pipe ($E_{2+n\cdot\Phi}$) is injected into the next upstream diluting pipe ($E_{n+1\cdot I}$) to dilute the raw pulp liquid having a higher concentration of liquid chemicals than the washing liquid in the (n+2)-th stage. Thereafter, again only the washing liquid is extracted from the concentrating pipe ($E_{n+1\cdot\Phi}$) located downstream thereof.

The raw pulp liquid washed in the pipe line by repeating the above-mentioned operations has its concentration regulated in the stage ($E_{D\cdot I}$) at the downstream end, and the resultant clean raw pulp liquid (36) is transferred to the next step of the process. On the other hand, the washing liquid (34) is transferred from the first stage concentrating pipe ($E_{1\cdot\Phi}$) to the next step of the process.

One example of the concentrating pipe ($E_{i\cdot\Phi}$) is illustrated in FIG. 2, and one example of the diluting pipe ($E_{i\cdot I}$) is illustrated in FIG. 3. At first, referring to FIG. 2, raw pulp liquid (40) has only washing liquid (40) therein passed through a trainer provided in a pipe (51) (slits or holes being opened in the pipe (51)) and flows towards the downstream end as raw pulp liquid (42) having a higher pulp concentration. It is to be noted that in these figures, reference numeral (50) designates flanges, numeral (52) designates a washing liquid reservoir, and numeral (53) designates in FIG. 2 an extraction port for washing liquid but it designates in FIG. 3 an injection port for washing liquid.

In a diluting pipe shown in FIG. 3 such as, for instance, the diluting pipe ($E_{n+1\cdot I}$), raw pulp liquid (43) supplied from the concentrating pipe ($E_{n\cdot\Phi}$) in the preceding stage flows into the pipe (51) associated with a trainer, washing liquid (41) extracted from the concentrating pipe ($E_{n+2\cdot\Phi}$) in the next downstream stage flows into the piping (51) through the injection port (53) as shown at (44), and diluted raw pulp liquid (45) flows out of the diluting pipe ($E_{n+1\cdot I}$) to the downstream concentrating pipe ($E_{n+1\cdot\Phi}$).

FIG. 4 shows an installation in which the method according to the present invention is practiced. In this installation, chips of wood (30) are passed through a rotary valve (1) and then introduced into a continuous digesting apparatus (2) containing liquid chemicals and maintained at a high temperature and at a high pressure to be subjected to digesting effect, and thereby they are pulped. The pulp (31) produced as a result of pulping falls into a cooling tank (3) while being associated with liquid chemicals, and after it is cooled and diluted by diluting liquid (33) supplied through a line (8), it is extracted externally of the system and transferred to a drum washing apparatus in the next step of the process.

During the above-mentioned process, clean water or washing liquid (32) having a lower concentration than the liquid chemicals in the raw pulp liquid is injected into a diluting pipe (5) through a line (10) to dilute the raw pulp liquid. The diluted raw pulp liquid has only the washing liquid extracted from a concentrating pipe (6), the raw pulp liquid (36) having its pulp concentration raised is passed through a line (7) as being washed, and then it is transferred to the next step of the process.

The diluting liquid extracted from the concentrating pipe (6) passes through a line (11), then joins with the diluting liquid (33), and is fed to the cooling tank (3) through the line (8) to be used for diluting the raw pulp liquid. The washing liquid contained in the raw pulp liquid diluted in this cooling tank (3) is extracted from a concentrating pipe (4) through a line 9 as washing liquid (34) collected after washing, and then transferred to the next step in the process. In this way, the pulp (31) is subjected to washing effect in the pipe line, and made into clean raw pulp liquid (36).

As described above, the present invention is practiced in the following mode. That is, the system is constructed of pipe lines, diluting pipes and concentrating pipes, and after clean water or washing liquid having a lower concentration than the liquid chemicals in the raw pulp liquid has been injected into an arbitrary diluting pipe ($E_{n+2 \cdot I}$) shown in FIG. 1 to dilute and mix with the raw pulp liquid, only the washing liquid is extracted in the downstream concentrating pipe ($E_{n+2 \cdot \Phi}$). Then the washing liquid extracted from the concentrating pipe ($E_{n+2 \cdot \Phi}$) is injected into the upstream diluting pipe ($E_{n+1 \cdot I}$) having a higher concentration than the liquid chemicals in the raw pulp liquid which has been partly washed in the (n+2)-th stage, and again only the washing liquid is extracted from the downstream concentration pipe ($E_{n+1 \cdot \Phi}$). After the raw pulp liquid has been washed in the pipe line by repeating such operations, it is subjected to concentration regulation at the downstream end of the washing and then transferred to the next step of the process. On the other hand, the washing liquid collected after washing is also transferred to the next step in the process as maintained in the condition where the concentration of the liquid chemicals has been most increased.

As described in detail above, according to the present invention, raw pulp liquid consisting of pulp and liquid chemicals is washed with clean water or washing liquid having a lower concentration than the liquid chemicals in the raw pulp liquid by making use of all or a part of pipe line, hence the washing can be achieved in a pipe line, and therefore, a volume of the drum cleaning apparatus in the prior art can be reduced and, as a whole, the system can be made compact. Also, in the case where a drum washing apparatus has been already installed and it is desired to increase the washing capability of the system, if the method according to the present invention is employed, then reconstruction and/or rearrangement of the washing system can be made minimum.

What is claimed is:

1. A process of washing a raw pulp liquid consisting of a mixture of pulp and raw chemicals by directing the raw pulp material sequentially through a pulp washing system composed of an alternating series of perforated diluting pipes and concentrating pipes, separated and spaced apart, said process comprising directing the raw pulp liquid alternately through a diluting pipe where it is diluted through the perforations in the diluting pipes with clean water or washing liquid having a lower pulp concentration than that of the raw pulp, and then through a concentration pipe where the pulp is extracted and the pulp concentrated due to the passage of the liquid in said pulp through the perforations in the concentration pipe to produce a washing liquid having a lower concentration than the raw pulp liquid to be extracted; collecting the thus-produced washing liquid from the concentration pipe, and directing said washing liquid in a counter-flow direction from said concentration pipe to a diluting pipe upstream of the direction of the flow of the pulp material.

2. A method according to claim 1 in which the most downstream diluting pipe with respect to the flow of the raw pulp liquid material is diluted with clean water or wash water and then directed to the final concentrating pipe downstream of the diluting pipe where only the washing liquid is extracted, said washing liquid being directed to the next upstream diluting pipe to dilute the raw pulp liquid therein and wherein this process is continuously carried out in this manner throughout the whole pulp washing system.

* * * * *